US006718940B2

(12) United States Patent
Usko

(10) Patent No.: US 6,718,940 B2
(45) Date of Patent: Apr. 13, 2004

(54) HYDRAULIC LASH ADJUSTER WITH COMPRESSION RELEASE BRAKE

(75) Inventor: James N. Usko, North Grandby, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 282 days.

(21) Appl. No.: 09/949,937

(22) Filed: Sep. 12, 2001

(65) Prior Publication Data

US 2002/0035978 A1 Mar. 28, 2002

Related U.S. Application Data

(63) Continuation-in-part of application No. 09/283,737, filed on Apr. 2, 1999, now abandoned.
(60) Provisional application No. 60/080,606, filed on Apr. 3, 1998.

(51) Int. Cl.[7] ..... F02D 13/04
(52) U.S. Cl. ..... 123/322; 123/90.36; 123/90.53; 123/90.63
(58) Field of Search ..... 123/90.36, 90.39, 123/90.42, 90.43, 90.45, 90.46, 90.51, 90.52, 90.53, 90.55, 90.61, 90.62, 90.63, 320, 321, 322

(56) References Cited

U.S. PATENT DOCUMENTS 3,220,392 A 11/1965 Cummins ..... 123/321
3,786,792 A 1/1974 Pelizzoni et al. ..... 123/97 B
3,809,033 A 5/1974 Cartledge ..... 123/90.46
3,911,873 A 10/1975 Dave ..... 123/302
4,009,695 A 3/1977 Ule ..... 123/90.13
4,220,122 A 9/1980 Aoyama ..... 123/90.55
4,387,680 A 6/1983 Tsunetomi et al. ..... 123/198 F
4,399,787 A 8/1983 Cavanagh ..... 123/321

(List continued on next page.)

*Primary Examiner*—Willis R. Wolfe
*Assistant Examiner*—Johnny H. Hoang
(74) *Attorney, Agent, or Firm*—Collier Shannon Scott, PLLC

(57) ABSTRACT

The present invention is directed to an improved assembly for operating at least one exhaust valve and at least one intake valve in a cylinder in an engine. The assembly includes a rocker shaft, an intake rocker arm pivotally mounted on the rocker shaft for operating at least one intake valve of the engine cylinder, an exhaust rocker arm pivotally mounted on the rocker shaft for operating at least one exhaust valve of the engine cylinder. The improved assembly includes a lash adjusting assembly for adjusting a lash between at least one of the intake rocker arm and the at least one intake valve, and the exhaust rocker arm and the at least one exhaust valve. The improvement further includes a fluid supply assembly for supplying fluid to the lash adjusting assembly to operate the lash adjusting assembly. The improved assembly further includes a control assembly for controlling the operation of the supply assembly in response to predetermined engine operating conditions.

26 Claims, 2 Drawing Sheets

U.S. PATENT DOCUMENTS

| | | | | |
|---|---|---|---|---|
| 4,572,114 | A | 2/1986 | Sickler | 123/21 |
| 4,724,801 | A | 2/1988 | O'Neill | 123/90.12 |
| 5,025,761 | A | 6/1991 | Chen | 123/90.15 |
| 5,036,810 | A | 8/1991 | Meneely | 123/321 |
| 5,146,890 | A | 9/1992 | Gobert et al. | 123/321 |
| 5,186,130 | A | 2/1993 | Melchior | 123/90.35 |
| 5,282,443 | A | 2/1994 | Fujiyoshi et al. | 123/90.16 |
| 5,421,308 | A | 6/1995 | Hitomi et al. | 123/559.1 |
| 5,495,838 | A | 3/1996 | Johnson, Jr. | 123/322 |
| 5,507,261 | A | 4/1996 | Johnson, Jr. | 123/322 |
| 5,537,976 | A | 7/1996 | Hu | 123/322 |
| 5,564,385 | A | 10/1996 | Hakansson | 122/321 |
| 5,586,531 | A | 12/1996 | Vittorio | 123/320 |
| 5,606,960 | A | 3/1997 | Takahashi et al. | 123/680 |
| 5,609,133 | A | 3/1997 | Hakansson | 123/321 |
| 5,619,965 | A | 4/1997 | Cosmo et al. | 123/322 |
| 5,626,116 | A | 5/1997 | Reedy et al. | 123/321 |
| 5,647,318 | A | 7/1997 | Feucht et al. | 123/322 |
| 5,679,094 | A | 10/1997 | Nakamura et al. | 477/111 |
| 5,680,841 | A | 10/1997 | Hu | 123/322 |
| 5,809,952 | A | 9/1998 | Ono et al. | 123/90.16 |
| 5,839,453 | A | 11/1998 | Hu | 123/322 |
| 5,857,438 | A | 1/1999 | Barnard | 123/90.16 |
| 5,890,469 | A | 4/1999 | Hakansson et al. | 123/321 |
| 5,960,754 | A | 10/1999 | Sugimoto et al. | 123/90.15 |
| 5,975,251 | A | 11/1999 | McCarthy | 188/31 |
| 6,000,374 | A | 12/1999 | Cosma et al. | 123/321 |
| 6,244,257 | B1 | 6/2001 | Hu | 123/568.14 |
| 6,253,730 | B1 | 7/2001 | Gustafson | 123/321 |
| 6,257,183 | B1 | 7/2001 | Vorih et al. | 123/90.12 |
| 6,293,248 | B1 * | 9/2001 | Zsoldos et al. | 123/321 |
| 6,394,067 | B1 * | 5/2002 | Usko et al. | 123/321 |
| 6,422,186 | B1 * | 7/2002 | Vanderpoel | 123/90.15 |

* cited by examiner

HYDRAULIC LASH ADJUSTER WITH COMPRESSION RELEASE BRAKE

CROSS REFERENCE TO RELATED PATENT APPLICATIONS

This application is a continuation in part of, relates to and claims the priority of U.S. patent application Ser. No. 09/283,737 filed Apr. 2, 1999, now abandoned which relates to and claims priority on provisional application Ser. No. 60/080,606, filed Apr. 3, 1998.

FIELD OF THE INVENTION

The present invention relates generally to a hydraulic lash adjuster assembly for use in a diesel engine having a compression release retarder. In particular, the present invention is directed to a system that permits an engine to operate under positive power with a hydraulic lash adjuster to remove unwanted lash and to disable the hydraulic lash adjuster when operating with a compression release retarder.

BACKGROUND OF THE INVENTION

Today the use of hydraulic lash adjusters in heavy duty diesel engines is nonexistent or in limited use at best. However, with the technological advancements and discussions of hydraulic overheads, camless engines with hydromechanical valve control, and lost motion devices, the hydraulic lash adjuster is sure to be standard equipment before any of the other mechanisms mentioned. The hydraulic lash adjuster mechanism is a standard component in most automotive gasoline engines on the road today, and has become reliable for that industry.

A commonly used device added to the heavy duty diesel engine is a compression release retarder, also known as an engine brake. This device actuates one or more exhaust valves when the engine is in a braking mode of operation. The use of an automatic hydraulic lash adjuster on the exhaust rocker arms of an engine equipped with an engine brake may not work. The constant flow of oil to the hydraulic lash adjuster may cause the hydraulic lash adjuster plunger to protrude further out of its assembly during the brake operation, resulting in the valve not seating at the end of the engine cycle.

OBJECTS OF THE INVENTION

It is an object of the present invention to provide a hydraulic lash adjuster in a diesel engine having a compression release retarder.

It is another object of the present invention to provide a hydraulic lash adjuster in a diesel engine to remove unwanted lash during positive power.

It is another object of the present invention to provide a hydraulic lash adjuster in a diesel engine that can be disabled during a compression release retarding operation.

It is another object of the present invention to provide a hydraulic lash adjuster in an engine to permit modification of valve timing during positive power.

It is another object of the present invention to provide a hydraulic lash adjuster in an engine to permit modification of lift during positive power.

It is another object of the present invention to provide a hydraulic lash adjuster in a diesel engine for improved emissions during positive power.

Additional objects and advantages of the invention are set forth, in part, in the description which follows and, in part, will be apparent to one of ordinary skill in the art from the description and/or from the practice of the invention.

SUMMARY OF THE INVENTION

The present invention is directed a system for use in a diesel engine having a compression release retarder. The system includes a hydraulic lash adjuster assembly located on at least one of an intake rocker arm and an exhaust rocker arm. The rocker arms are pivotally mounted on a rocker shaft. The rocker shaft includes a passageway for each of the intake rocker arm and the exhaust rocker arm to provide a supply of hydraulic fluid to operate the hydraulic lash adjusters on the intake rocker arm and the exhaust rocker arm. At least one solenoid valve on the rocker shaft is provided to control the flow of hydraulic fluid through the passageways to operate the hydraulic lash adjusters on the exhaust and intake rocker arms. A control assembly is provided to control the operation of the solenoid valves. The control assembly controls the operation of the solenoid valves to permit operation of the adjusters during positive power and to deactivate the adjusters during a compression release retarding operation. Furthermore, the operation of the control assembly permits the lash adjusters to be operated to adjust valve timing during positive power.

The system also includes a brake rocker arm assembly having its own dedicated cam lobe or a conventional engine brake to facilitate engine braking.

The present invention is directed to an improved assembly for operating at least one exhaust valve and at least one intake valve in a cylinder in an engine. The assembly includes a rocker shaft, an intake rocker arm pivotally mounted on the rocker shaft for operating at least one intake valve of the engine cylinder, an exhaust rocker arm pivotally mounted on the rocker shaft for operating at least one exhaust valve of the engine cylinder. The improved assembly includes a lash adjusting assembly for adjusting a lash between at least one of the intake rocker arm and the at least one intake valve, and the exhaust rocker arm and the at least one exhaust valve. The improvement further includes a fluid supply assembly for supplying fluid to the lash adjusting assembly to operate the lash adjusting assembly. The improved assembly further includes a control assembly for controlling the operation of the fluid supply assembly in response to predetermined engine operating conditions.

A first lash adjusting assembly may be located on an intake rocker arm, wherein the lash adjusting assembly adjusts the lash between the intake rocker arm and the at least one intake valve. A second lash adjusting assembly may be located on an exhaust rocker arm, wherein the lash adjusting assembly adjusts the lash between the exhaust rocker arm and the at least one exhaust valve. Finally, the improved assembly may include a pair of the lash adjusting assemblies to adjust the lash between the exhaust rocker arm and the at least one exhaust valve and between the intake rocker arm and the at least one intake valve.

The fluid supply assembly may supply hydraulic fluid to the lash adjusting assembly to operate the lash adjusting assembly. The fluid supply assembly may comprise fluid passages in the rocker arm to supply hydraulic fluid to the lash adjusting assembly. The fluid supply assembly may further include passages and a solenoid valve located on the rocker shaft.

The control assembly may operate the fluid supply assembly to supply fluid to the lash adjusting assembly during positive power. The control assembly may operate the supply assembly to deactivate the lash adjusting assembly during an engine braking operation. The control assembly may operate the supply assembly to deactivate the lash adjusting assembly after the control assembly senses a predetermined engine operating condition. The control assembly is capable of operating the supply assembly to operate the lash adjusting assembly to modify valve timing of at least one of the at least one exhaust valve and the at least one intake valve. Furthermore, the control assembly is capable of operating the supply assembly to operate the lash adjusting assembly to modify valve lift of at least one of the at least one exhaust valve and the at least one intake valve. Additionally, the control assembly is capable of operating the supply assembly to operate the lash adjusting assembly to modify overlap of the at least one exhaust valve and the at least one intake valve.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The invention will be described in conjunction with the following drawings in which like reference numerals designate like elements and wherein.

DETAILED DESCRIPTION OF THE PREFERRED EMBODIMENTS

Figure 1:
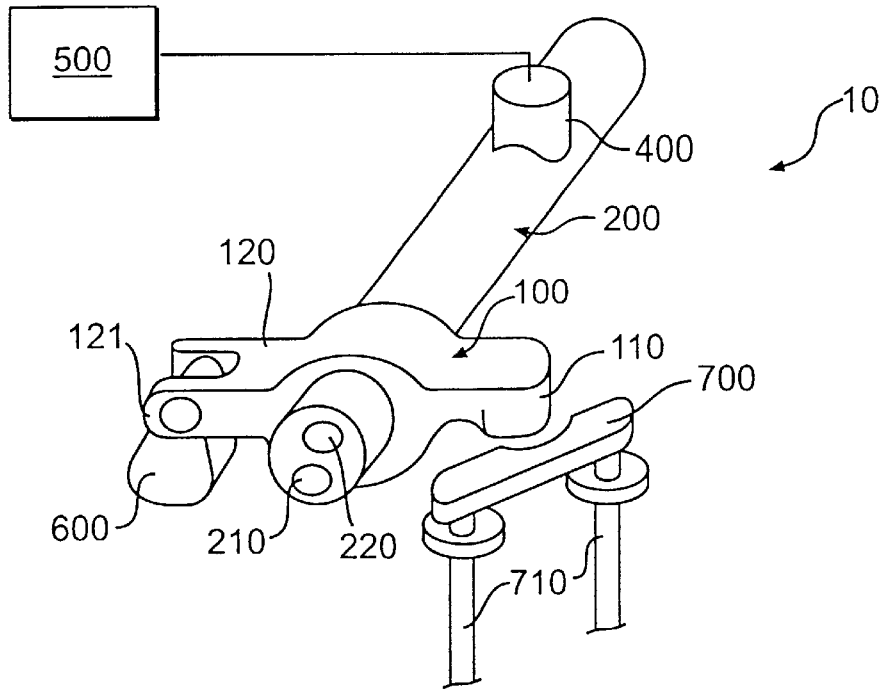
FIG. 1 is a schematic of the hydraulic lash adjuster system in accordance with an embodiment of the present invention.

FIG. 1 illustrates a rocker arm assembly 10 for use in operating at least one cylinder valve in an internal combustion engine. A single rocker arm assembly 10 is depicted for illustrative purposes only. It is to be understood that a separate rocker arm assembly 10 may be provided to operate at least one exhaust valve and to operate at least one intake valve associated with a cylinder. The rocker arm assembly 10 includes a rocker arm 100 that is pivotally mounted on a rocker shaft 200. The rocker arm assembly 10 further includes a hydraulic lash adjuster assembly 300 (FIG. 2) that is extends out of the rocker arm 100. The rocker arm assembly 10 further includes at least one valve 400 for controlling the operation of the hydraulic lash adjuster assembly 300. The operation of the valve 400 is controlled by a control assembly 500.

The rocker shaft 200 may include at least two passages therein. A first passage 210 supplies lubrication, such as, for example, hydraulic fluid to the moving components in the valve train. A second passage 220 supplies hydraulic fluid to the hydraulic lash adjuster 300 located on the rocker arm 100. The second passage 220 and the valve 400 may comprise a substantial portion of the fluid supply assembly.

Figure 2:
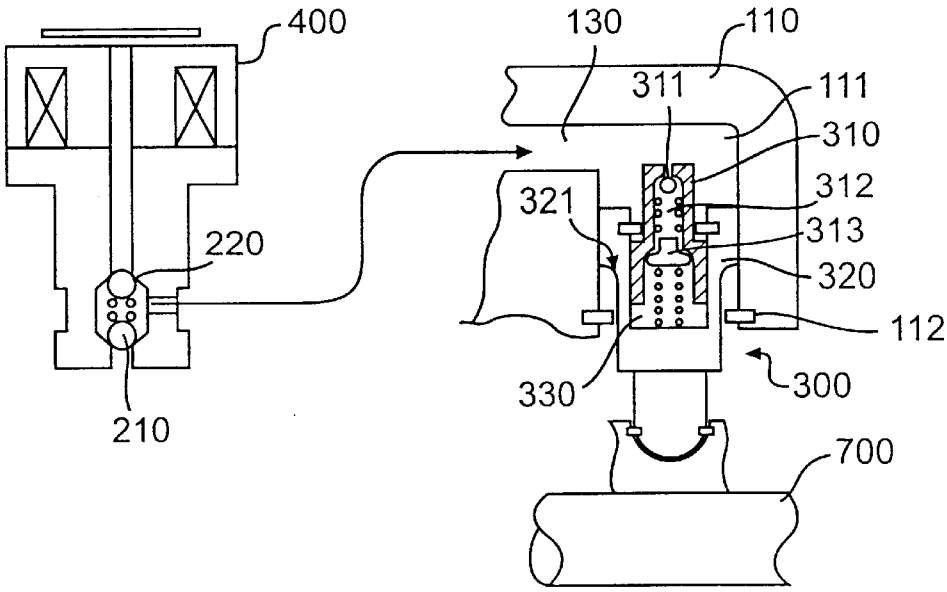
FIG. 2 is an schematic view in partial cross-section of the hydraulic lash adjuster system in accordance with an embodiment of the present invention.

The rocker arm 100 includes a first end 110 and a second end 120. The hydraulic lash adjuster 300 is located within a cavity 111 within the first end 110 of the rocker arm 100, as shown in FIG. 2. A passageway 130 extends within the rocker arm 100 from the cavity 111 in the first end 110 to the rocker shaft 200 such that the hydraulic lash adjuster 300 is fluidly connected to the second passage 220. The second end 120 of rocker arm 100 includes a follower assembly 121. The follower assembly 121 is adapted to follow the profile of a cam lobe assembly 600 either directly as shown, or indirectly through a valve train member such as a push tube.

The hydraulic lash adjuster 300 will now be described. The lash adjuster 300 is mounted within the cavity 111 within the first end 110 of the rocker arm 100, as shown in FIG. 2. The lash adjuster 300 includes an inner plunger 310 and an outer plunger 320. The outer plunger 320 is slidably received within the cavity 111. The inner plunger 310 is slidably received within the outer plunger 320 to form a chamber there between having an upper portion 312 and a lower portion 330. The upper end of the inner plunger 310 is adapted to seat against the end wall of the cavity 111. A check valve 311 is biased by a first spring in the upper chamber portion 312 into a closed position over the opening in the upper end of the inner plunger 310. A second spring located in the lower chamber portion 330 biases the inner plunger 310 upward by pressing against an intermediate member, spring stop 313.

In operation, during positive power, hydraulic fluid flows into the cavity 111 from passageway 130. The fluid entering the cavity 111 initially forces the outer plunger 320 downward. At the same time, the fluid entering the cavity 111 opens the check valve 311 in the inner plunger 310 allowing fluid to flow into the chamber between the inner and outer plungers. As the upper and lower chamber portions 312 and 330 fill with fluid, the inner plunger 310 moves upward, further separating from the outer plunger 320 until it seats against the end wall of the cavity 111. The upward movement of the inner plunger 310 relative to the outer plunger 320 is assisted by the bias of the spring in the chamber lower portion 330. The collective movement of the inner and outer plungers, causes the outer plunger 320 to move sufficiently downward to engage a crosshead 700. The downward movement of the outer plunger 320 may be limited by the shoulder 321 engaging the surface 112 in the cavity 111. Once the inner plunger 310 is seated against the end wall of the cavity 111 and the outer plunger 320 is seated against the crosshead 700, the lash adjuster 300 is hydraulically locked and mechanically connected between the rocker arm 100 and the crosshead 700. The crosshead 700 is then capable of operating at least one valve 710 in response to bumps on the cam 600.

The control assembly 500 controls the operation of the valve 400 to supply hydraulic fluid to the lash adjuster assembly 300. The control assembly 500 may be integrated into the control assembly of the engine. Alternatively, the control assembly 500 may be a separate control assembly. The valve 400 is preferably a normally open three-way solenoid valve. The control assembly 500 may sense engine speed, fuel on/off mode, clutch engagement, and various positive power conditions to identify the need to reduce valve lash.

The operation of the rocker arm assembly 10 will now be described. During positive power operation, hydraulic fluid flows through the first passage 210 of the rocker shaft 200 to lubricate various members including but not limited to the rocker arm bushing, the follower assembly 121 and the valve train. The control assembly 500 operates the valve 400 to supply hydraulic fluid through the second passage 220 to the passageway 130 to operate the hydraulic lash adjuster assembly 300. The lash adjuster assembly 300 extends to take up any unwanted lash. This allows the engine to operate in a valve timing mode that is optimized for a particular engine speed.

When the engine brake is activated, the control assembly 500 operates the valve 400 to deactivate the flow of hydraulic fluid to the hydraulic lash adjuster assembly 300. The fluid within the cavity 111 and the passageway 130 is permitted to drain which allows the inner plunger 310 and the outer plunger 320 to retreat to a collapsed position. Tolerances between the inner plunger 310 and the outer plunger 320 allow oil in the chamber there between to leak out into the cavity 111 when hydraulic pressure in the cavity is reduced. The engine brake, not shown, can then be operated to operate the at least one exhaust valve as an engine brake.

Figure 3:
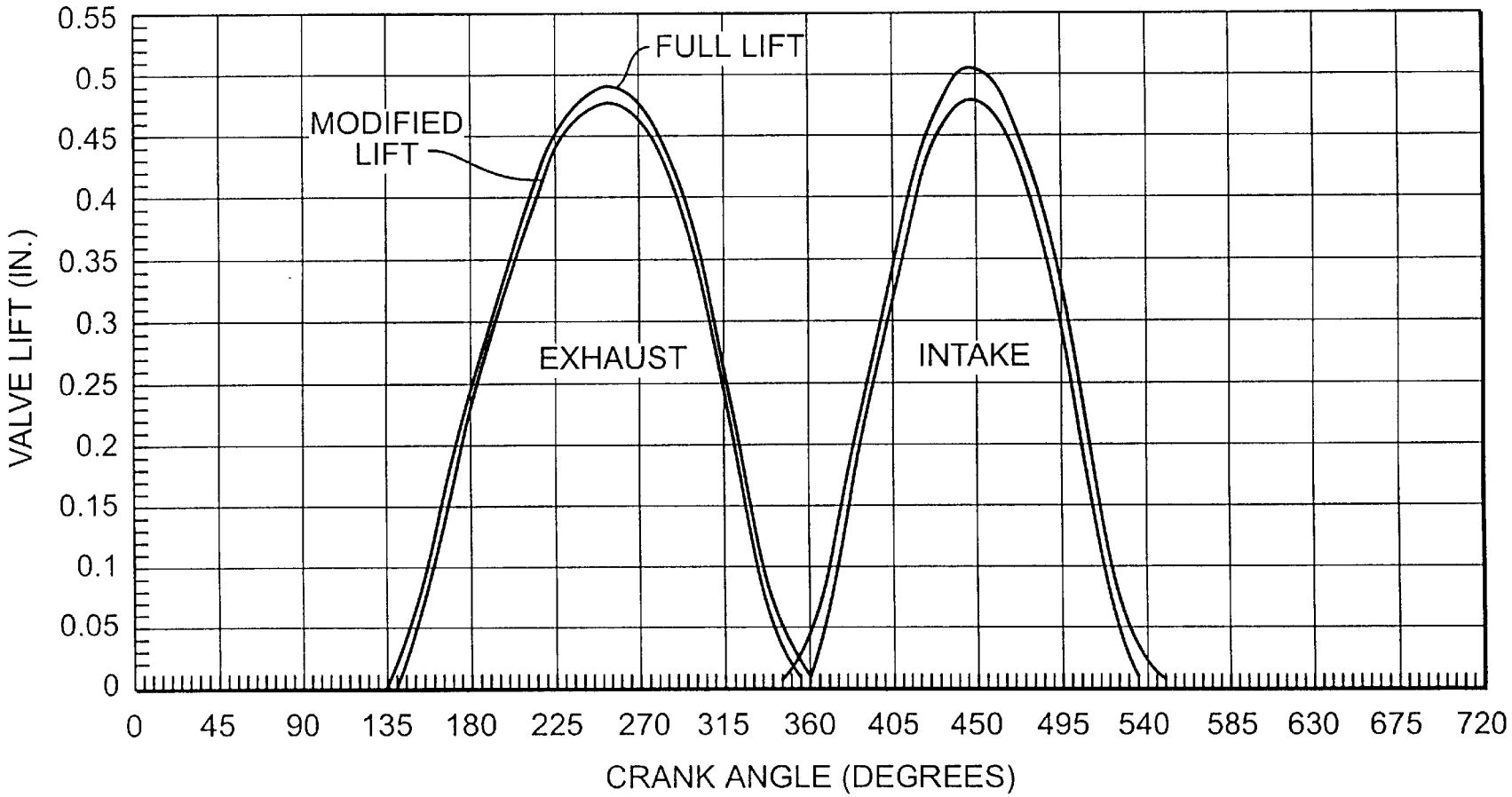
FIG. 3 is a graph depicting the modified valve timing achieved in accordance with an embodiment of the present invention.

If the control assembly 500 determines that a change in valve overlap is necessary during positive power, the control assembly 500 can activate the valve 400 in the rocker shaft 200 and cause the lash adjuster assembly 300 to collapse and change valve timing, overlap and lift, as shown in FIG. 3. With additional valves the exhaust and intake could be operated separately, allowing only the exhaust or intake valve timing vary from a set condition.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An assembly for operating an engine valve comprising:

a rocker shaft;

a rocker arm pivotally mounted on the rocker shaft, said rocker arm including a cavity at a valve actuation end, said cavity having an end wall;

a hydraulic lash adjuster slidably disposed in the rocker arm cavity, said hydraulic lash adjuster including an outer plunger slidably received in the cavity and an inner plunger slidably received in the outer plunger, wherein said inner plunger is adapted to selectively contact the cavity end wall;

a hydraulic passage provided in the rocker arm, said passage communicating with the rocker arm cavity; and means for (a) supplying hydraulic fluid to the passage during a positive power mode of engine operation and (b) cutting off the supply of hydraulic fluid to the passage during an engine braking mode of engine operation.

2. The assembly of claim 1 wherein the means for supplying and cutting off supply comprises a normally open three-way solenoid valve during positive power operation.

3. The assembly of claim 1 wherein the means for supplying and cutting off supply is mounted on the rocker shaft.

4. The assembly of claim 1 wherein the means for supplying and cutting off supply provides hydraulic fluid flow control for a plurality of lash adjusters.

5. The assembly of claim 1 further comprising a check valve in the inner plunger.

6. The assembly of claim 5 further comprising a spring disposed between the inner plunger and the outer plunger, said spring adapted to bias the inner and outer plungers apart.

7. The assembly of claim 6 further comprising a spring stop disposed between the spring and the inner plunger.

8. The assembly of claim 1 further comprising a spring disposed between the inner plunger and the outer plunger, said spring adapted to bias the inner and outer plungers apart.

9. An assembly for operating an engine valve comprising:

a rocker shaft;

a rocker arm pivotally mounted on the rocker shaft, said rocker arm including a cavity at a valve actuation end;

a hydraulic lash adjuster slidably disposed in the rocker arm cavity;

a hydraulic passage provided in the rocker arm, said passage communicating with the rocker arm cavity; and means for (a) supplying hydraulic fluid to the passage during a positive power mode of engine operation, (b) selectively cutting off the supply of hydraulic fluid during the positive power mode of operation in response to the determination of a need for a change in engine valve timing, lift, or overlap, and (c) cutting off the supply of hydraulic fluid to the passage during an engine braking mode of engine operation.

10. The assembly of claim 9 wherein said hydraulic lash adjuster comprises:

an outer plunger slidably received in the cavity; and an inner plunger slidably received in the outer plunger.

11. The assembly of claim 10 wherein the inner plunger comprises:

an internal chamber with an upper end and a lower end;

a check valve disposed in the upper end of the inner plunger internal chamber; and a spring disposed in the lower end of the inner plunger internal chamber.

12. The assembly of claim 9 wherein the means for supplying and cutting off supply comprises a normally open three-way solenoid valve during positive power operation.

13. The assembly of claim 9 wherein the means for supplying and cutting off supply is mounted on the rocker shaft.

14. An assembly for operating an engine valve comprising:

a rocker shaft;

a rocker arm pivotally mounted on the rocker shaft, the rocker arm including a cavity at a valve actuation end, the cavity having an end wall;

a lash adjuster disposed in the rocker arm cavity; and means for (a) activating the lash adjuster during a positive power mode of engine operation and (b) deactivating the lash adjuster during an engine braking mode of engine operation.

15. The assembly of claim 14 wherein the means for activating and deactivating the lash adjuster is mounted on the rocker shaft.

16. The assembly of claim 14 wherein the means for activation and deactivation provides control for a plurality of lash adjusters.

17. An assembly for operating an engine valve comprising:

a rocker shaft;

a rocker arm pivotally mounted on the rocker shaft, said rocker arm including a cavity at a valve actuation end;

a lash adjuster slidably disposed in the rocker arm cavity; and means for (a) selectively activating and deactivating the lash adjuster during a positive power mode of engine operation in response to the determination of a need for a change in engine valve timing, lift, or overlap, and (b) deactivating the lash adjuster during an engine braking mode of engine operation.

18. The assembly of claim 17 wherein the means for activating and deactivating the lash adjuster is mounted on the rocker shaft.

19. An engine valve lash adjuster comprising:

an outer plunger;

an inner plunger slidably received in the outer plunger;

a check valve in the inner plunger;

a spring disposed between the inner plunger and the outer plunger, the spring adapted to bias the inner and outer plungers apart; and a spring stop disposed between the spring and the inner plunger.

20. A method of operating an engine valve lash adjuster disposed in a rocker arm in an internal combustion engine, the method comprising the steps of:

determining that the engine is operating in a positive power mode;

supplying hydraulic fluid to the lash adjuster in response to the determination that the engine is operating in a positive power mode of operation;

determining that the engine is operating in an engine braking mode; and cutting off the supply of hydraulic fluid to the lash adjuster in response to a determination that the engine is operating in an engine braking mode of operation.

21. The method of claim 20, wherein the lash adjuster comprises an outer plunger and an inner plunger slidably received in the outer plunger, and further comprising the steps of:

separating the outer and inner plungers responsive to the supply of hydraulic fluid to the lash adjuster; and collapsing the outer and inner plungers responsive to the supply of hydraulic fluid to the lash adjuster.

22. The method of claim 21 further comprising the step of seating the inner plunger against an internal surface of the rocker arm in response to the supply of hydraulic fluid to the lash adjuster.

23. The method of claim 20 further comprising the step of seating the inner plunger against an internal surface of the rocker arm in response to the supply of hydraulic fluid to the lash adjuster.

24. A method of operating an engine valve lash adjuster in an internal combustion engine comprising the steps of:

determining that an engine is operating in a positive power mode;

supplying hydraulic fluid to a lash adjuster in response to a determination that the engine is operating in a positive power mode of operation;

determining whether a change in engine valve timing, lift, or overlap is required;

selectively cutting off the supply of hydraulic fluid to the lash adjuster in response to a determination of a required change in engine valve timing, lift, or overlap;

determining that the engine is operating in an engine braking mode; and cutting off the supply of hydraulic fluid to the lash adjuster in response to a determination that the engine is operating in an engine braking mode of operation.

25. A method of operating an engine valve lash adjuster in an internal combustion engine, the method comprising the steps of:

determining that the engine is operating in a positive power mode;

activating the lash adjuster in response to the determination that the engine is operating in a positive power mode of operation;

determining that the engine is operating in an engine braking mode; and deactivating the lash adjuster in response to a determination that the engine is operating in an engine braking mode of operation.

26. A method of operating an engine valve lash adjuster in an internal combustion engine comprising the steps of:

determining that an engine is operating in a positive power mode;

activating the lash adjuster in response to a determination that the engine is operating in a positive power mode of operation;

determining whether a change in engine valve timing, lift, or overlap is required;

selectively deactivating the lash adjuster in response to a determination of a required change in engine valve timing, lift, or overlap;

determining that the engine is operating in an engine braking mode; and deactivating the lash adjuster in response to a determination that the engine is operating in an engine braking mode of operation.

* * * * *